US005433349A

United States Patent [19]

Romanyszyn, Jr.

[11] Patent Number: 5,433,349

[45] Date of Patent: Jul. 18, 1995

[54] MIXING AND FLUSHING DEVICE FOR JUICE DISPENSING TOWER

[75] Inventor: Michael T. Romanyszyn, Jr., San Antonio, Tex.

[73] Assignee: The Coca-Cola Company, Atlanta, Ga.

[21] Appl. No.: 239,005

[22] Filed: May 6, 1994

[51] Int. Cl.[6] ..... B67D 5/56

[52] U.S. Cl. ..... 222/129.2; 222/129.4; 222/145.5; 222/148

[58] Field of Search ..... 222/129.2, 129.4, 145, 222/148

[56] References Cited

U.S. PATENT DOCUMENTS

| | | | |
|---|---|---|---|
| 4,684,332 | 8/1987 | Hartley et al. | 417/397 |
| 4,765,513 | 8/1988 | McMillin et al. | 222/148 X |
| 4,807,783 | 2/1989 | van Zijverden | 222/148 |
| 4,941,593 | 7/1990 | Hicks et al. | 222/148 |
| 4,941,596 | 7/1990 | Marty et al. | 222/148 X |

FOREIGN PATENT DOCUMENTS

| | | | |
|---|---|---|---|
| 2462387 | 3/1981 | France | 222/148 |
| 2623039 | 12/1977 | Germany | 222/148 |
| 7610470 | 3/1977 | Netherlands | 222/148 |

*Primary Examiner*—Andres Kashnikow
*Assistant Examiner*—Kenneth Bomberg
*Attorney, Agent, or Firm*—Thomas R. Boston

[57] ABSTRACT

A mixing and flushing device for use on a proportioning pump of a juice tower dispenser. The device includes a housing having a water inlet connected to the pump water outlet, a concentrate inlet connected to the pump concentrate outlet, a flushing water inlet, a mixing chamber, and a single outlet from the mixing chamber. A poppet valve at the concentrate inlet to the chamber feeds the concentrate in a thin annular stream where it is hit by the water. The flushing water hits the poppet valve and automatically forces it closed during cleaning.

8 Claims, 5 Drawing Sheets

MIXING AND FLUSHING DEVICE FOR JUICE DISPENSING TOWER

BACKGROUND OF THE INVENTION

This invention relates to a tower type juice dispenser and in particular to a mixing and flushing device fix use therewith.

Juice dispensing towers are well-known, including all parts of the system of this invention except for the mixing and flushing device. Previously the water outlet and the concentrate outlet from the proportioning pump were connected together at a T and mixed together in a hit-or-miss fashion in the length of line between the T and the dispensing faucet of the tower. To flush the system required lines to be disconnected and new lines connected, after having pulled the pumps out of the under-the-counter unit for access thereto.

SUMMARY OF THE INVENTION

A mixing and flushing device for use on a proportioning pump of a juice tower dispenser. The device occupies very little vertical space such that it fits in the small space available above the proportioning pumps in the under-the-counter unit of a juice tower dispenser. The small device not only provides an excellent mixing chamber for improved mixing of the water and juice concentrate, but also includes a flushing line and check valve for feeding flushing water into the mixing chamber, where the water hits and automatically maintains the concentrate poppet valve closed.

BRIEF DESCRIPTION OF THE DRAWINGS

The present invention will be more fully understood from the detailed description below when read in connection with the accompanying drawings wherein like reference numerals refer to like elements and wherein.

DETAILED DESCRIPTION OF THE PREFERRED EMBODIMENT

Figure 1:
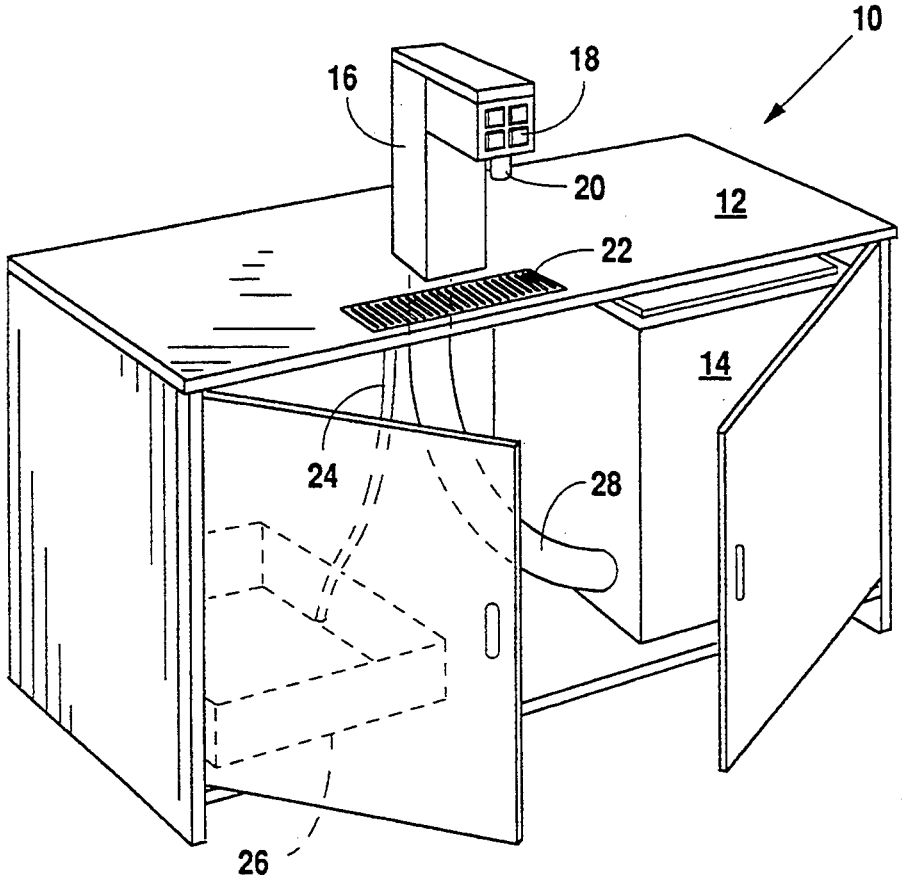
FIG. 1 is a perspective view showing the overall arrangement of a juice dispensing tower in which the present invention can be used.

With reference now to the drawings, FIG. 1 shows an overview of a juice dispensing tower 10 with which this invention can be used. The tower 10 includes a counter 12, an under-the-counter unit 14, a tower 16 having four buttons 18 for dispensing four different flavors from a single nozzle 20 above a grate 22 from which a tube 24 feeds spilled liquid into a tank 26. A python 28 leads from the unit 14 to the tower 16 and includes four beverage lines and two recirculating water lines inside of an insulating tube.

Figure 5:
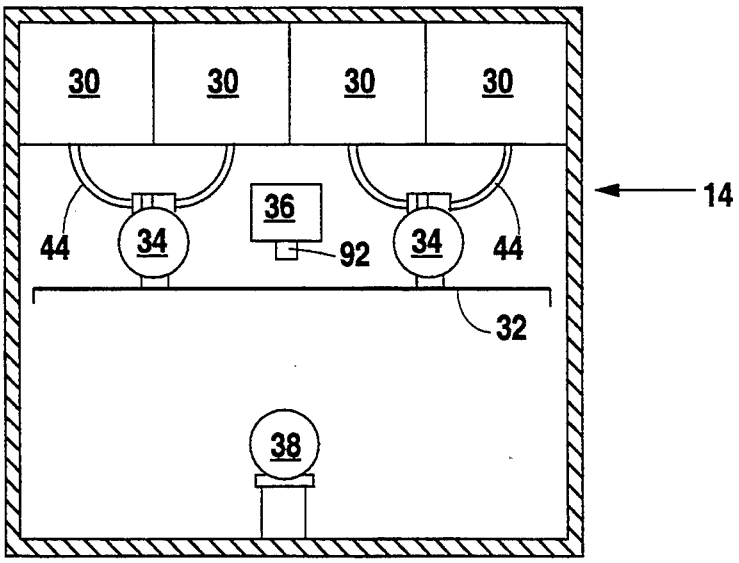
FIG. 5 is a schematic, broken-away front view of the under-the-counter unit.
Figure 6:
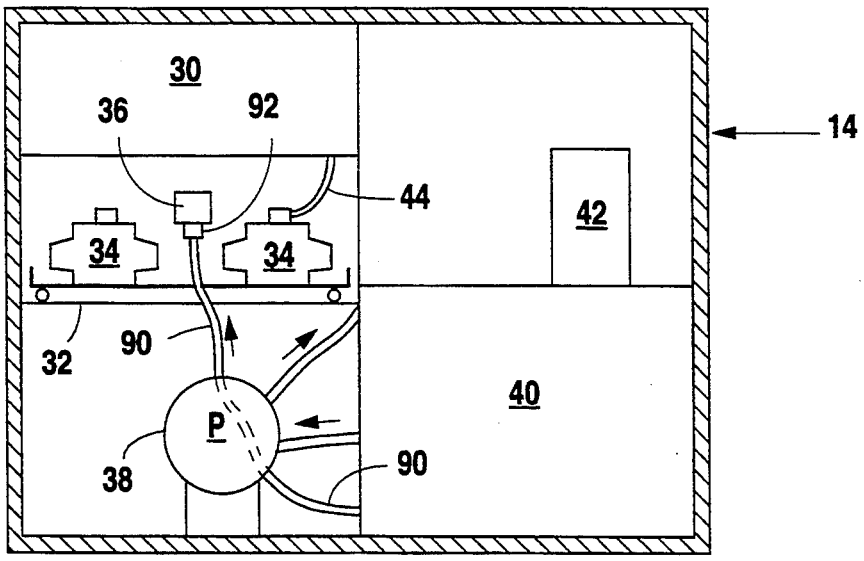
FIG. 6 is a schematic, broken-away side view of the under-the-counter unit.

FIGS. 5 and 6 show diagrammatically what is inside of the unit 14. FIG. 5 shows the front of the unit 14 wherein at the top are located four concentrate containers 30. Below the containers 30 is a pull-out tray 32 on which four proportioning pumps 34, such as the type shown in U.S. Pat. No. 4,684,332, are located, along with a manifold and solenoid block 36. Below the pumps 34 is a recirculating pump 38 for pumping cold water up and back through the python 28.

FIG. 6 shows the side of the unit 14 and shows the items discussed above at the front of the unit. At the back of the unit 14 on the bottom is a cold water bath 40 with water cooling coils and on top is a pull-out refrigeration deck 42 (including condenser, motor condenser coils, etc.). FIG. 5 also shows concentrate lines 44 each going from one of the containers 30 to a respective one of the pumps 34. A water line goes from a cooling coil (not shown) in the water bath 40 to the block 36 where four solenoids 46 control the water flow to the pumps.

When a selected button 18 is pushed for a selected juice beverage from a choice of, for example, orange juice, apple juice, grapefruit juice, etc., the appropriate one of the solenoids is energized sending water to the appropriate pump, which then draws concentrate through a check valve to that pump and from that pump the mixture of water and concentrate to the nozzle 20 of the tower 16.

The mixing and flushing device 50 of the present invention will now be described with reference to FIGS. 2–4. The device 50 is attached on top of a proportioning pump 34 which has a water inlet 52, a concentrate inlet 54, a water outlet 56 and a concentrate outlet 58. Prior to this invention, the two outlets 56 and 58 would be connected by a T to a single line to the tower nozzle, and the water and concentrate would hopefully mix in the line.

Figure 2:
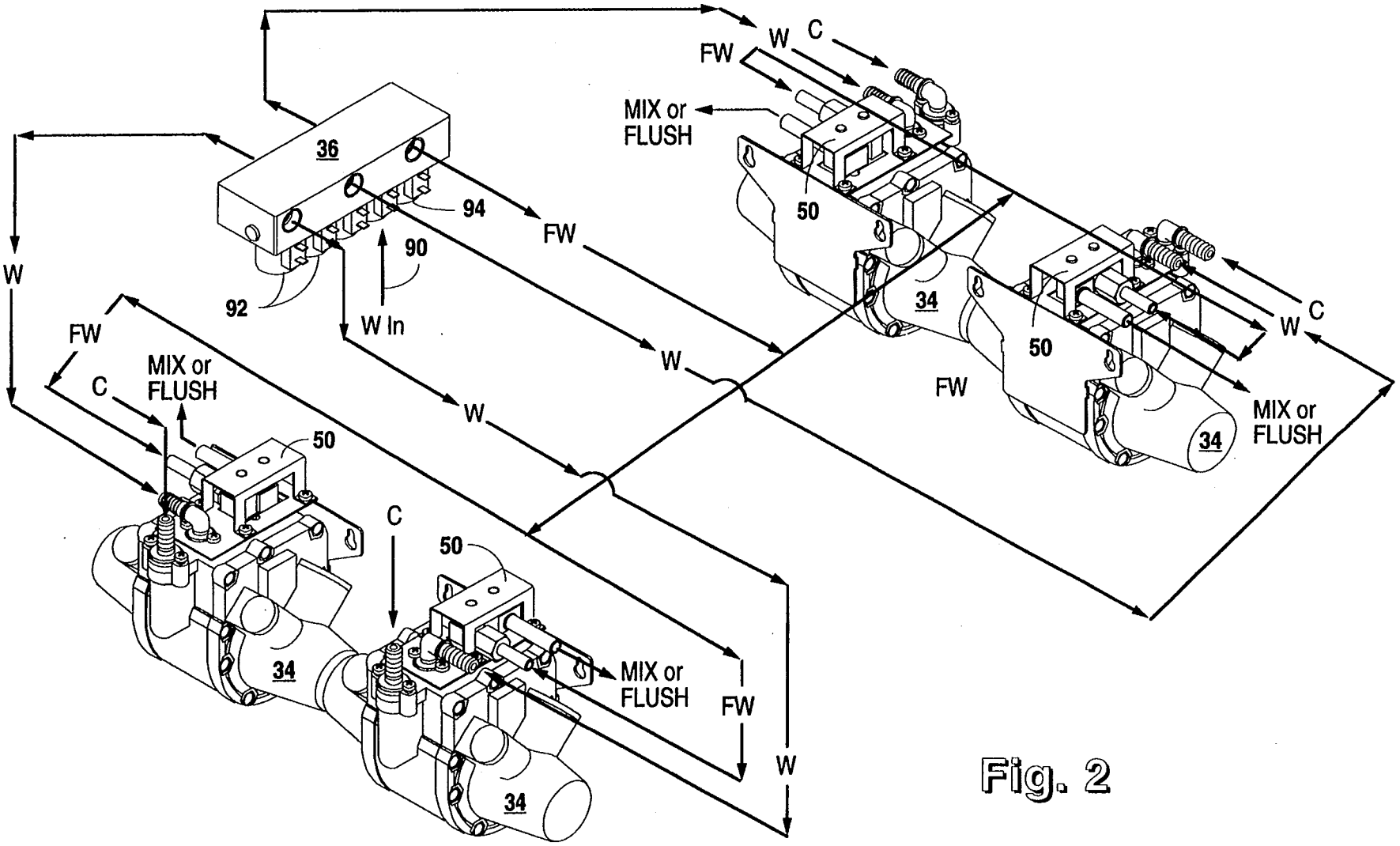
FIG. 2 is a perspective view showing four proportioning pumps each with one of the mixing and flushing devices of the present invention.

FIG. 2 shows four proportioning pumps 34 used in a four flavor tower dispensing system, along with the manifold and solenoid block 36. These pumps 34 and block 36 are mounted on a pull-out tray 32. One of the devices 50 is mounted on each of the pumps 34. A description of one device 50 will now be provided with reference to FIGS. 3 and 4.

Figure 3:
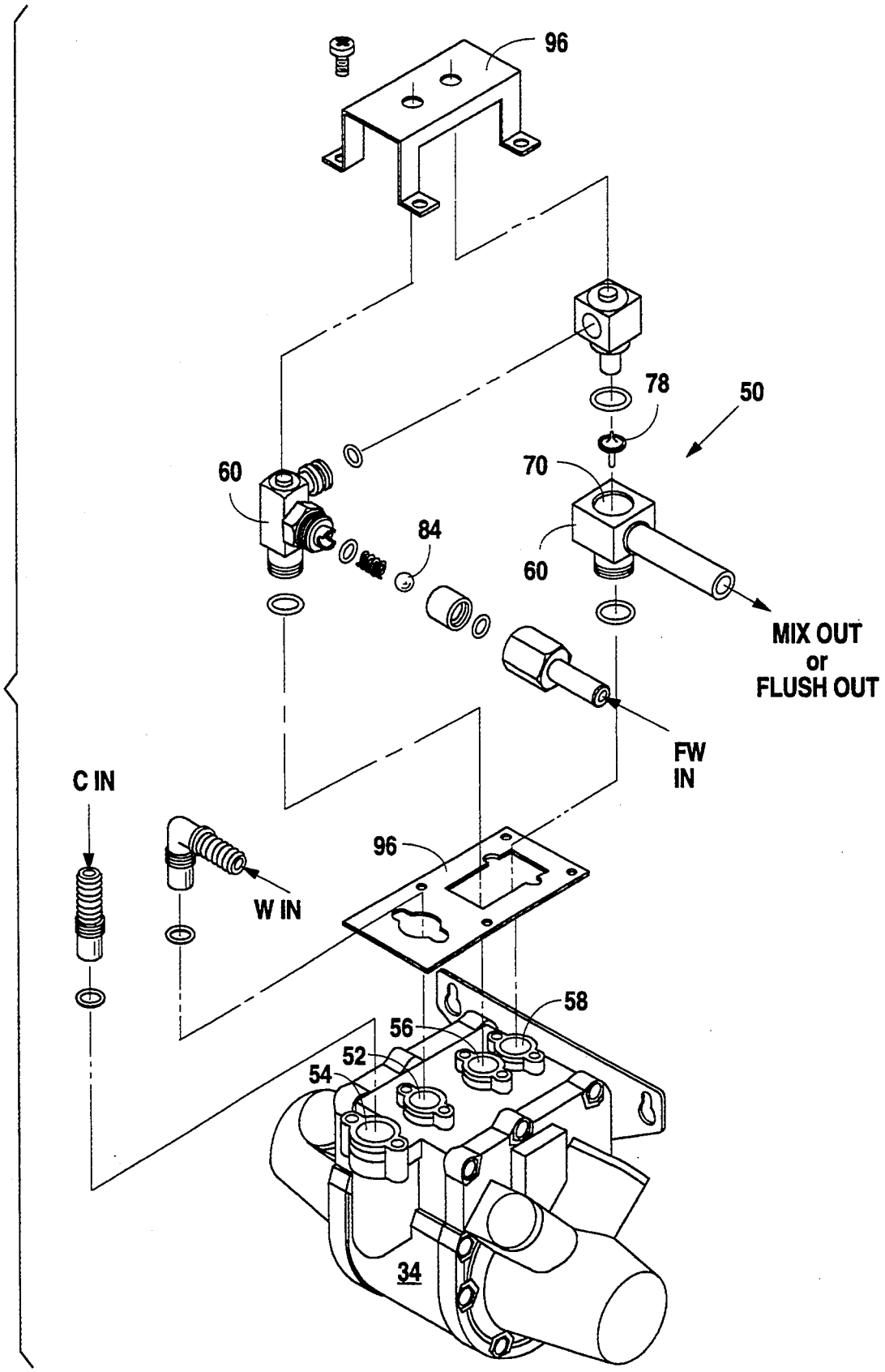
FIG. 3 is a partly exploded perspective view of one proportioning pump with the mixing and flushing device of this invention exploded.
Figure 4:
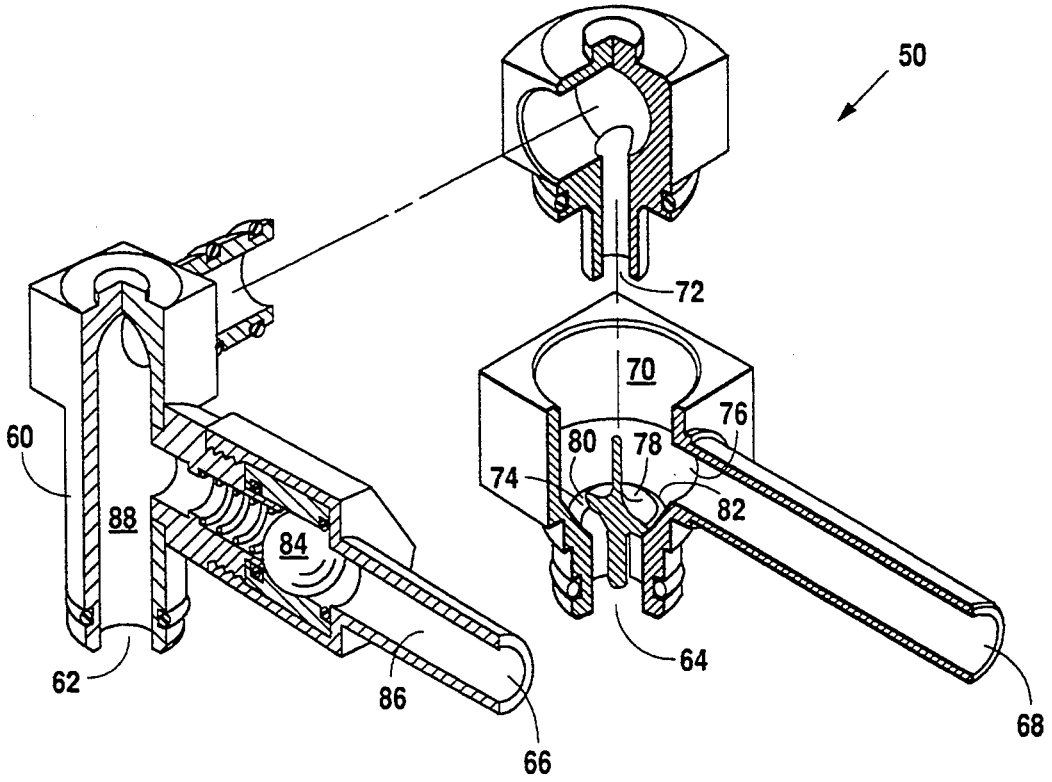
FIG. 4 is a partly broken away, exploded, perspective view of the mixing and flushing device of this invention.

FIGS. 3 and 4 show a device 50 comprising a housing 60 having a water inlet 62, a concentrate inlet 64, a flushing water inlet 66, an outlet 68, and a mixing chamber 70 having a water inlet opening 72, a concentrate opening 74, and a side outlet opening 76. A poppet valve 78 is movably located in the concentrate opening. The concentrate opening 74 has a circular valve seat 80. The poppet valve 78 has a circular edge 82 which seals against the valve seat 80. A ball and spring check valve 84 is located in a flushing water passageway 86 which leads to a water passageway 88 from the water inlet 62 to the water opening 72.

Each of the concentrate containers 30 is connected by a concentrate line 44 to a respective one of the pumps 34. The concentrate passageway in the pump has a check valve which opens only when the pump is activated. A water line 90 feeds cold water from cooling coils in the water bath 40 to the block 36. Four solenoids 92 are connected to the block 36 and control water flow to a respective one of the four pumps 34. A fifth solenoid 94 controls the flow of flushing water to all four pumps at the same time. The flushing water lines are connected to the four flushing water inlets 66.

In operation, when a selected button 18 is pushed, a selected one of the four solenoids is energized, sending water to the pump 34 for that flavor (connected to the appropriate concentrate container 30). The water causes the pump to be energized drawing concentrate into the pump and out with water into the device 50, where they mix in the mixing chamber and are fed out the outlet 68 through the python 28 and out the nozzle 20 of the tower 16.

When the flushing button is pushed, the solenoid 94 sends the same water to all four devices through the flushing water inlet 66, opening the check valve 84, forcing the poppet valve closed, and flowing out the outlet opening 76 and out the nozzle 20, cleaning all the passageways and surfaces touched by the concentrate downstream from the pump. The pump and containers 30 are maintained cold by virtue of their proximity to the cold water bath.

The poppet valve 78 will move tip a short distance when concentrate is pumped to provide a small annular orifice through which only a thin stream of concentrate flows. It is hit hard and violently by the water to provide excellent mixing in the chamber 70.

The chamber 70 is preferably cylindrical and the top of the poppet valve is concave to assist the water in spreading out into contact with the thin stream of concentrate. The bottom wall 96 of the chamber is tapered to also assist mixing.

The force of the flushing water hitting the poppet valve will maintain it closed.

A bracket 96 conveniently holds the device 50 in place.

While the preferred embodiment of this invention has been described above in detail, it is to be understood that variations and modifications can be made therein without departing from the spirit and scope of the present invention.

What is claimed is:

1. A mixing and flushing device for use on a proportioning pump of a juice dispenser, comprising:

(a) a housing having a water inlet, a concentrate inlet, a flushing water inlet, and an outlet;

(b) said housing including a mixing chamber therein having an upper water inlet opening, a lower concentrate opening having a circular valve seat where said concentrate opening meets said chamber, and a side outlet opening;

(c) a poppet valve in said concentrate opening and having a circular peripheral edge in contact with said valve seat when said poppet valve is in a closed sealing position and having a concave upper surface for receiving water from said water inlet opening and for causing said water to spread out toward said edge;

(d) said poppet valve being movable upwardly to an open position when concentrate is pumped into said chamber, providing a narrow annular concentrate opening into said chamber where the water spreading out from the upper surface of the poppet valve contacts a thin layer of concentrate and mixes vigorously with it, and the mixture then leaves the chamber through said side outlet opening;

(e) a first water passageway extending from said water inlet to said water inlet opening;

(f) a flushing water passageway extending from said flushing water inlet into said first water passageway at a point intermediate its length; and (g) a one-way valve in said flushing water passageway allowing flushing water to go in the direction from said flushing water inlet to said first water passageway.

2. The device as recited in claim 1 wherein said chamber has a lower wall that tapers downwardly toward said valve seat.

3. The device as recited in claim 2 wherein said chamber is cylindrical.

4. The device as recited in claim 1 wherein the height of said device is less than two inches.

5. The device as recited in claim 1 wherein said housing is connected to a proportioning pump having a water inlet, a concentrate inlet, a water outlet, and a concentrate outlet, and wherein said water inlet of said housing is connected to said water outlet of said pump, and said concentrate inlet of said housing is connected to said concentrate outlet of said pump.

6. The device as recited in claim 5 including a flushing water line connected to said flushing water inlet of said housing.

7. The device as recited in claim 1 including four such proportioning pumps with one of said devices for each pump and a manifold solenoid block mounted between pumps on a pull-out tray.

8. The device as recited in claim 7 wherein said block has five solenoids and five outlets, four for water connected one each to a pump water inlet and one connected to each of said flushing water inlets of each of said four devices.

* * * * *